US005514457A

United States Patent [19]

Fels et al.

[11] Patent Number: 5,514,457

[45] Date of Patent: May 7, 1996

[54] TEXTILE STRUCTURE FOR PROTECTIVE CLOTHING

[75] Inventors: Achim G. Fels, Wuppertal; Georg K. Brustmann, Aschaffenburg; Dieter H. P. Schuster, Wuppertal, all of Germany

[73] Assignee: Akzo N.V., Arnhem, Netherlands

[21] Appl. No.: 203,490

[22] Filed: Feb. 28, 1994

Related U.S. Application Data

[63] Continuation of Ser. No. 901,692, Jun. 22, 1992, abandoned.

[30] Foreign Application Priority Data

Jun. 21, 1991 [DE] Germany ..... 41 20 454.9
May 20, 1992 [DE] Germany ..... 42 16 657.8

[51] Int. Cl.[6] ..... F41H 1/02; D03D 3/00; D02G 3/00; B32B 5/02

[52] U.S. Cl. ..... 428/229; 2/2.5; 428/233; 428/373; 428/377; 428/911

[58] Field of Search ..... 428/373, 377, 428/375, 390, 911, 255, 259, 279, 233

[56] References Cited

U.S. PATENT DOCUMENTS

| | | | |
|---|---|---|---|
| 3,729,920 | 5/1973 | Sayers et al. | 57/229 |
| 3,983,282 | 9/1976 | Seemann III | 428/114 |
| 4,479,984 | 10/1984 | Levy et al. | 427/54.1 |
| 4,559,262 | 12/1985 | Cogswell et al. | 428/294 |
| 4,822,245 | 4/1989 | Aubry et al. | 416/134 A |
| 4,861,621 | 8/1989 | Kanzaki | 427/54.1 |
| 4,921,756 | 5/1990 | Tolbert et al. | 428/377 |
| 4,927,698 | 5/1990 | Jaco et al. | 428/377 |
| 4,958,485 | 9/1990 | Montgomery et al. | 428/377 |
| 4,967,548 | 11/1990 | Fangeal et al. | 428/379 |
| 5,050,406 | 9/1991 | Strauss et al. . | |
| 5,087,499 | 2/1992 | Sullivan . | |
| 5,119,512 | 6/1992 | Dunbar et al. | 428/377 |
| 5,119,644 | 6/1992 | Strauss et al. . | |
| 5,233,821 | 8/1993 | Weber, Jr. et al. | 428/911 |

FOREIGN PATENT DOCUMENTS

| | | |
|---|---|---|
| 0310201 | 4/1989 | European Pat. Off. . |
| 0375113 | 6/1990 | European Pat. Off. . |
| 0416486 | 3/1991 | European Pat. Off. . |
| 2628759 | 9/1989 | France . |
| 3820091 | 12/1989 | Germany . |
| 3918318 | 5/1990 | Germany . |
| 3929376 | 4/1991 | Germany . |
| 8603023 | 6/1988 | Netherlands . |

OTHER PUBLICATIONS

"High Performance Textiles", Elsevier Science Publishers, B. V., 1987, vol. 8, No. 3, pp. 14–15.

H. Fuchs, "Herstellung von Multikomponentengarnen mit dem Friktionsspinnverfahren Production of Multi–Component Yarns by the Friction Spinning Process", Melliand Textilberichte, 1983, vol. 64, pp. 618–622.

E. Kleinhanslk, "Schutzkleidung gegen Stoss–und Stichwaffen", Textil Praxis International, Feb. 1992, pp. 125–131. (Abstract attached) (Abstract only).

"Herstellung technischer Garne mit den Dref–Spinnsystemen", Chemiefasern/Textil–industrie, Apr. 1982, pp. 284 and 287. (Abstract attached) (Abstract Only).

*Primary Examiner*—James D. Withers
*Attorney, Agent, or Firm*—Oliff & Berridge

[57] ABSTRACT

Textile structures, such as fabrics, knits, warp-knitted fabrics, stitch-bonded fabrics, thread structures, etc. for use in clothing which protects against stabbing, cutting, fragments and bullets, are produced from wrapped yarns. These yarns have a core of penetration resistant fibers and an outer sheath of natural and/or manmade fibers that can easily be dyed, printed, or optically brightened.

30 Claims, 1 Drawing Sheet

TEXTILE STRUCTURE FOR PROTECTIVE CLOTHING

This is a continuation of application Ser. No. 07/901,692 filed Jun. 22, 1992, now abandoned.

FIELD OF THE INVENTION

The invention relates to a textile structure for manufacturing protective clothing, especially clothing which protects the wearer against stabbing, cutting, fragments, and bullets.

BACKGROUND

Aromatic polyamide fibers have proven highly effective for use in protective clothing, especially for protection against injury from stabbing, cutting, fragments or bullets. Thus for example, the World Fencing Association has prescribed the use of fencing jackets made of aromatic polyamide fibers to avoid the serious injuries that recur when engaging in this sport (High Performance Textiles, Vol. 8, No. 3, p. 14). Protective clothing made of aromatic polyamide fibers has demonstrated very high reliability in preventing injuries when used to protect the body against injury from bullets and fragments encountered in military, police, and disaster control applications. In addition to aromatic polyamide fibers, polyolefin fibers, especially polyethylene fibers, produced by the "gel" spinning process, are also used in these applications.

Aromatic polyamide fibers suffer from several disadvantages when used in protective clothing. In many applications, the natural yellow color of the aromatic polyamide fibers poses difficulties. It is possible with certain limitations to dye these fibers, but it does not help in all cases to cover up the undesired natural color of the aromatic polyamide fibers.

The undesirable natural color of aromatic polyamide fibers is especially evident in articles that must be white since, thus far, no way to bleach or optically brighten these fibers is known. Therefore, protective clothing made of aromatic polyamide fibers is usually manufactured so that the fabric providing the protection and made of aromatic polyamide fibers is covered with an outer material composed of fibers that can be readily dyed, printed, or optically brightened, thus to lend the clothing an aesthetic appearance. For example, in fencing vests, the protective layer of aromatic polyamide fibers is provided with an outer material composed of a fabric produced from polyester-cotton yarns (High Performance Textiles, Vol. 8, No. 3, p. 14).

Like all polyamide fibers, aromatic polyamide fibers undergo a decrease in strength when exposed to intense light. The cover layer in the form of an outer material over the actual protective layers fulfills other purposes as well, namely protecting the aromatic polyamide fibers against damage by exposure to light. In addition, the use of an outer material made of natural fibers increases the wearing comfort of protective clothing.

The manufacture of protective clothing using cover layers however means that several different fabrics must be kept in stock for the cover layers and the actual protective layers, and that a differentiated storage procedure is also required for different cover layers, because, for example, the same outer materials cannot be used for fencing vests and bulletproof vests. In the case of fencing vests, white outer materials are required, while bulletproof vests usually require outer materials that are dyed or printed.

Hence, objects of the present invention include: 1) provide for production of improved clothing which protects against injury from stabbing, cutting, fragments, and bullets; 2) provide textile structures used to manufacture the protective clothing; 3) simplify ordering requirements in the ready-to-wear protective clothing industry; and 4) make the manufacture of this protective clothing less expensive.

SUMMARY OF THE INVENTION

Surprisingly, it has now been found that a considerable simplification of the manufacture of these various types of protective clothing is possible while improving, or at least retaining, the advantageous properties of the protective clothing previously manufactured. A wrapped yarn, also known as a core spun yarn, consisting of a core of penetration resistant fiber, such as aromatic polyamide or other suitable fiber (for example, gel spun polyethylene fiber) having a sheath of natural or manmade fibers or mixtures thereof which are readily color-modifiable (e.g., readily dyed, printed, or optically brightened) is used. Exemplary penetration resistant fibers include cutting and stabbing resistant and antiballistic (e.g., bullet and fragment resistant) fibers. Textile structures made from these yarns can significantly reduce the above-mentioned ordering problems in an inexpensive manner. Inventory can now be limited to one type of textile structure for different applications.

Another advantage gained over previously known textile processes is that wrapped yarns made of aromatic polyamide fibers receive a higher degree of protection from processing damage, and hence exhibit less strength loss as a result of processing. Also, the period of serviceability of protective vests made from the textile structures according to the invention is considerably extended.

DETAILED DESCRIPTION OF PREFERRED EMBODIMENTS

Figure 1:
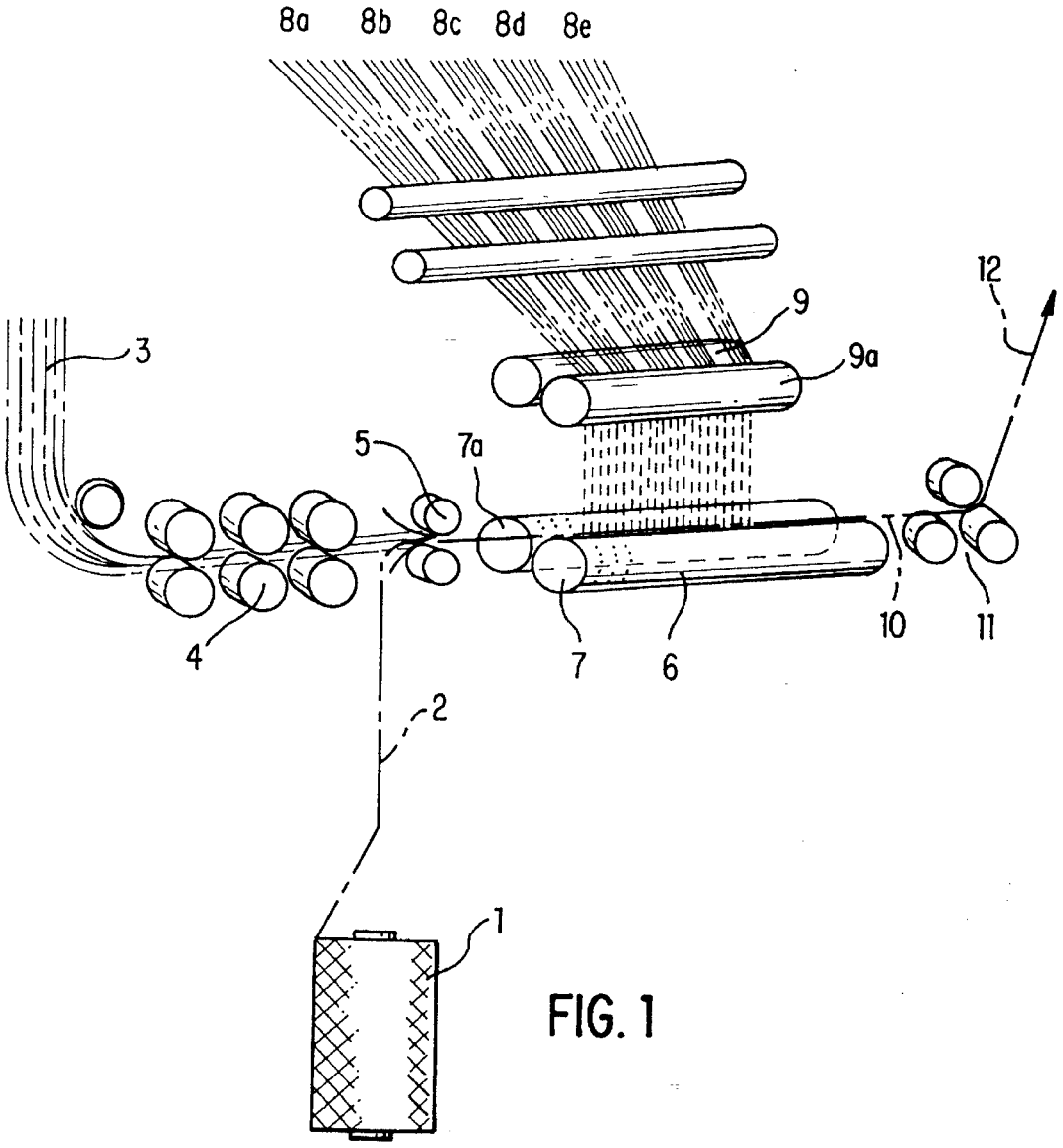
FIG. 1 illustrates a schematic representation of the manufacture of wrapped yarns having a double sheath.

The manufacture of wrapped yarns is generally known in spinning. The DREF 3 process, developed by Textilmaschinenfabrik Dr. Ernst Fehrer AG, is especially suited for the purpose. Its operation has already been described several times in the technical literature relating to textiles (e.g. Fuchs, H., "Manufacture of Multicomponent Yarns using the Friction Spinning Method"; Melliand Textilberichte, Vol. 64, 1983, pp. 618–622).

The manufacture of wrapped yarns for further processing into the textile structures according to the invention is not limited to the DREF 3 process. Other processes by which yarns with the same properties can be produced are equally well suited for manufacturing yarns further processed into the textile structures according to the invention.

Another process, likewise developed by Textilmaschinenfabrik Dr. Ernst Fehrer AG, is the DREF 2 process which has also been described several times in specialized textile literature. This process is not preferred for producing yarns subsequently processed into the textile structures according to the invention. In the interests of good wearing properties and a suitable aesthetic appearance of clothing articles made from the textile structures according to the invention, yarns that are as fine as possible should be used. However, the DREF 2 process is only suitable for making coarser yarns. Since the wrapped yarns for producing the textile structures according to the invention should be a fineness range from 200 to 4,000 dtex, the DREF 2 process does not provide yarns having the required properties for use in the present invention.

Another disadvantage of yarns made by the DREF 2 process over yarns made by the DREF 3 process is evident in further processing the yarns to produce the textile structures according to the invention. DREF 2 yarns have a less desired laminate structure than DREF 3 yarns. In yarns made by the DREF 2 process, the core and sheath layer are not as clearly separated as they are in yarns made by the DREF 3 process. The core and sheath layers in DREF 2 yarns are more intimately mixed than in DREF 3 yarns. This disadvantage of the DREF 2 process is especially evident in applications in which excellent protection of the core substance against irradiation by light is required. Tests have shown that for optimum protection of the core against irradiation, good separation of the core and sheath layers is required. This is especially true when a yarn with a double sheath is produced. Here, if good protection against light is to be ensured, the core layer, first sheath layer, and second sheath layer must be clearly separated from one another and must not be mixed with one another.

The core substance of the yarns used to manufacture the textile structures according to the invention preferably consists of aromatic polyamide fibers. These fibers, frequently also known as aramid fibers, are generally known in the textile industry by brand names, Twaron for example. They have rendered very good service primarily when used for clothing designed to provide protection against injury by stabbing, cutting, fragments, or bullets.

In addition, polyolefin fibers, especially polyethylene fibers made by the gel spinning process, can be used to form the core. Likewise, mixtures of these fibers, for example mixtures of aramid and polyethylene fibers, can be used.

Fibers for the core material can be used both as filament yarns and as staple fiber yarns. Which of the two forms is chosen depends on the desired yarn properties. In manufacturing yarns for further processing into protective clothing, filament yarns are preferred as the core substance, since higher strengths are obtained with filament yarns in contrast to staple fiber yarns.

There are no limits on the filament and yarn titers for the core material. The choice of yarn titer depends on the item to be manufactured. Finer titers are preferred over coarser ones.

The filament yarns in the core can be twisted or untwisted. Untwisted yarns are preferred, since the core yarn is twisted when wrapped using the DREF 3 process.

Staple fibers can be used to form the sheath substance. Natural or manmade fibers or mixtures thereof can be used for this purpose.

Especially good results, especially as regards wearing comfort and good take-up ability for dyes with different degrees of fastness and for optical brighteners, have been achieved with cotton. Similarly, viscose staple fibers are suitable for this application, and mixtures of cotton fibers and viscose staple fibers may be used as well.

The use of manmade fibers such as polyester, polyamide, or polyacrylonitrile fibers is possible as well. In this regard, in the interests of good wearing comfort, mixtures of synthetic fibers and cotton or viscose staple fibers are preferred. For example, a mixture that is known and frequently used in other articles is the combination of 50% cotton fibers and 50% polyester staple fibers.

Moreover, wool, alone or mixed with viscose or manmade staple fibers, may be used. To form the outer substance, fibers used for this purpose are supplied as a sliver with a sliver weight of 2–3 g/m, to the spinning machinery. This sliver is produced using the machines usually employed in three-cylinder spinning. When using cotton, it is advantageous to use a combed cotton. Fiber mixtures can be produced using known mixing methods employed in spinning. Advantageously, the so-called loose stock mixture is used. The sliver mixture may also be used; however, using the sliver mixture, it is necessary to perform several drafting passes to obtain a homogeneous distribution of the mixture components.

Fibers with a 30–60 mm staple fiber length are especially suited for wrapping by the DREF 3 process. Fibers of this kind are offered by manufacturers of manmade fibers in many forms. When cotton is used, fibers with a shorter staple fiber length may be readily used as well.

If wool is used to make the sheath layer, it is preferably prepared using three-cylinder spinning machinery. For slivers made of wool produced on this machinery, the term "wool short tops" has come into use. If wool mixed with a manmade staple fiber is used, the fiber length of the other ingredients in the mixture is selected accordingly. Manmade staple fibers with a staple fiber length of 60 mm have given good service in these yarns.

If it is desired to provide good protection of the core material against the effects of light, it is advantageous to wrap the core (e.g., a core made of aromatic polyamide fibers) in a double sheath. An inner sheath made of polyester fibers and an outer sheath made of cotton or viscose staple fibers is especially well suited for this purpose.

This double sheath material is produced by feeding a sliver made of polyester yarn for example into the spinning machine together with the yarn such as aramid yarn intended for the core, and forming the outer sheath in the usual manner known from the DREF 3 process using staple fibers such as cotton or viscose staple fibers.

FIG. 1 shows an example of the manufacture of wrapped yarns with a double sheath, in schematic form. A filament yarn 2 (e.g. an aramid yarn) is pulled off a bobbin 1 and fed to spinning mechanism 6. A sliver 3, of polyester staple fibers for example, is pulled out of a can, not shown, stretched on drawing system 4, and fed into clamping rollers 5 together with filament yarn 2. The yarn passes through spinning mechanism 6, comprised of perforated drums 7 and 7*a*. Both drums contain suction inserts, not shown. The fibers of sliver 3, as a result of the false twist that occurs in the clocking area above the suction drums, are wrapped around filament yarn 2, thus forming the inner sheath. Slivers 8*a*–8*e*, composed of cotton for example, are fed from cans, not shown, to opening rolls 9 and 9*a* and divided into individual fibers. The five slivers mentioned here are exemplary only. The number of slivers fed to the opening rolls can be varied at will. The divided fibers are sucked off by perforated drums 7 and 7*a* and are applied as an outer sheath to the filament yarn 2 already wrapped with the fibers from sliver 3. Yarn 10 leaving the spinning mechanism is fed to draw-off mechanism 11. The false twist produced by the resulting clamping action sets the sheath fibers. These fibers set the false twist produced on the core yarn. This produces yarn 12 wrapped with a double sheath.

Figure 2:
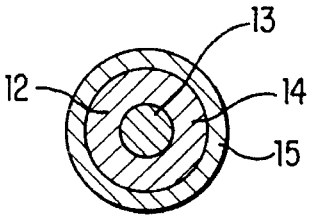
FIG. 2 illustrates a cross-section through a wrapped yarn produced according to the schematic manufacturing represented in FIG. 1.

FIG. 2 shows a cross section through yarn 12 produced on the equipment described above. An inner sheath 14, made of polyester staple fibers in this example, and an outer sheath 15, made of cotton in this example, are placed around core 13 made of aramid filament yarn in this example.

The invention is not limited to the polyester staple fibers or cotton fibers for the inner and outer sheath, respectively. The choice of the fiber material for the two sheath layers is determined by the properties desired for the yarn. For example, if good protection against light for a core such as a core made of aramid yarn is desired, it is advantageous to use polyester staple fibers for the inner sheath, since these exhibit good light absorption. Polyester fibers with suitable additives are especially preferred. Delustered polyester staple fibers have also proven highly suitable. The latter usually contain titanium dioxide, which has a light absorbent effect, especially in the UV range. Similarly, other fibers having the desired properties may be used. In selecting fibers to form the outer sheath, wearing comfort and easy dyeing, printing, or optical brightening are important criteria. The use of cotton fibers or viscose staple fibers or mixtures thereof is highly advantageous; mixtures of cotton or viscose staple fibers with manmade staple fibers can also be used. When using viscose staple fibers, delustered types that contain spun-on titanium dioxide are preferred.

Especially good protection of a core such as one made of aramid fibers against strength loss as a result of irradiation by light is achieved when the sheath layer is composed of a fiber that has been dyed to a dark hue.

The wrapped yarns with a core made of aromatic polyamide fibers or other suitable fibers or mixtures of these fibers with aramid fibers, and a single or double sheath made of fibers that can be readily dyed, printed, or optically brightened, may be further processed into textile structures. Textile structures include fabrics, knits, warp-knitted fabrics, stitch-bonded fabrics, thread structures, etc. Which method is selected for making textile structures from wrapped yarns depends on a number of different factors. One such factor of particular importance is the properties desired of the protective articles to be made from the textile structures. Thus for example, knitwear such as knits or warp-knits instead of fabrics has proven advantageous when a particular elasticity of the product to be made from the textile structure is required. Thread structures have proven to be especially advantageous because of the low manufacturing costs and the gentle processing of yarns made of aromatic polyamide fibers. The latter advantage does not have particular significance when wrapped yarns are used.

Further processing of staple fiber yarns into fabrics is preferred for many areas of application. All looms known in the weaving art may be used. Rapier looms have proven especially advantageous for this application. Just as in the case of the other textile structures, it is not necessary for fabrics to consist entirely of the same kind of yarns. Thus for example, in the case of fabrics, it is possible to have yarns with a cotton sheath running in one thread direction and yarns with a sheath made of viscose staple fibers in the other thread direction. Similarly, various other yarn combinations may be used.

The thread count to be selected depends on the titer of the yarn used and secondly on the nature of the protective clothing to be produced. Yarns with a titer ranging from 200 to 4,000 dtex are preferred.

In fabrics that are to be further processed into bulletproof vests, for example with a yarn titer of approximately 850 dtex, a thread count of 9–12 fibers/cm is preferably selected. For a titer of approximately 1,300 dtex, the thread count is preferably 7–10/cm, and at a titer of approximately 1,700 dtex, it is preferably 6–9/cm. These figures refer to fabric produced in a plain weave. In the case of fabrics to be processed further into fencing vests, higher thread counts are required.

No special requirements need be imposed on fabric binding. Plain weave has proven advantageous, but other weaves, for example, the twill and basket weaves, may likewise be used.

When manufacturing fabrics directly from aromatic polyamide fibers, a considerable loss of strength during the weaving process is unavoidable. Even with a very careful and gentle operating mode, this loss amounts to about 20%. Improper operation results in strength loss which can be as high as 50%. In this regard, one special advantage of fabrics made of wrapped yarns becomes apparent. By using a wrapped yarn with a core made of aromatic polyamide fibers and a sheath made of cotton for example, the loss of strength during weaving is significantly reduced. Strength loss using wrapped yarns according to the invention is usually less than 5%. The sheath formed by wrapping protects the core substance during the weaving process so that the loss of strength remains within tolerable limits.

Even in the case of other textile structures such as knits, warp-knitted fabrics, stitch-bonded fabrics, thread structures, etc., there are no limits on the type of machinery that can be used to produce them. The sheath layer of wrapped yarn also provides protection for the core during processing on the textile machinery and therefore makes a significant contribution to maintaining the favorable strength characteristics of the yarn during additional processing.

The textile structures according to the invention may be dyed, printed, or optically brightened using usual methods in the textile finishing process. In the case of fencing vests, the color is usually white. This means that the fibers used for the vest must usually be bleached and optically brightened. Bleaching the sheath fibers should advantageously take place before they are spun, in the loose stock. Piece bleaching is likewise possible but damage to an aramid core during piece bleaching must always be anticipated, due to the oxidizing agents that are almost always used for bleaching.

Whether bleaching is necessary at all depends upon the fibers used to form the sheath material. In the case of cotton and wool, this is necessary in the interests of a good degree of whiteness, while the manmade fibers that are already produced with a high degree of whiteness in many cases do not require the bleaching process. The producers of manmade fibers also offer so-called ultrawhite types. These contain optical brighteners that are added by spinning or in after-treatment. When manmade fibers or their mixtures are used it is advantageous to select ultrawhite types. This shows, in the case of a yarn with a double sheath, one advantage of viscose staple fiber over cotton when used to make the outer sheath.

Treating the textile structures according to the invention with optical brighteners poses no problems. For example this treatment can take place in the loose stock after bleaching the cotton. Optical brightening of the piece goods is also possible. In the textile finishing industry, the processes involved are known. The choice of a suitable product and the processing conditions depend on the fibers or fiber mixtures selected for the material composing the sheath.

Clothing to provide protection against fragments, bullets, stabbing or cuts may be either dyed or printed. The latter is typically for military applications. The processes to be used for dyeing and printing the textile structures according to the invention are likewise well known in the textile finishing industry. The choice of dyes as well as the processing method depends on the type of fiber or fiber mixture to be used for the sheath of the wrapped yarn as well as the desired fastness and possible other desirable properties, for example, camouflage colors for protective clothing in the military area. Dyes with dark colors are especially favorable as far as protection of aramid yarn cores against damage by exposure to light is concerned.

Whether dyeing is limited to the sheath layer or includes the core yarn depends on the desired effect and the yarn structure. Aramid fibers have a natural yellow color. When a yarn with a single sheath is used, in many yarn structures the yellow color of the core material shows through somewhat. This can be a problem in some applications. In such cases it is possible to dye the aramid core yarn with disperse dyestuffs. The high-temperature process known in the textile finishing industry by the abbreviation "HT process" is suitable for this purpose with dyeing temperatures up to 135° C. and occurs in the same manner as dyeing using carriers. Both methods are well known in the dyeing industry.

In making fencing vests, the textile structures according to the invention are processed to have one layer or many layers. In single-layer processing, textile structures according to the invention have a special advantage. Sewing with one outer material and possibly one backing can be eliminated, which, in addition to simplifying the ordering procedure for the materials kept in stock, also reduces product cost in the ready-to-wear garment manufacturing process. As far as wearing comfort is concerned, fencing vests made from the textile structures according to the invention offer considerable advantages over the fencing vests previously in conventional use, especially for single-layer processed textile structures manufactured according to the invention. A fencing vest produced without using an outer material or backing fits the athlete well, offering optimal freedom of movement.

In conventional fencing vests two or three layers of aramid fiber fabrics were used to achieve the required resistance to penetration, which must be above 800N to prevent injury to the athlete. It has been found that when fabric according to the invention is used a single-layer fencing vest provides the necessary resistance to penetration. A prerequisite however is that a dense fabric construction be chosen, i.e., a fabric with a high thread count in the warp and weft.

The values given for the resistance to penetration in the embodiments were determined by the method described by Kleinhansl (Kleinhansl E., "Clothing Protecting Against Thrusting and Stabbing Weapons—General Requirements, Testing Fencing Clothing", in *Textil Praxis International* 1992, pp. 125 to 130).

Protective vests for protection against bullets and fragments must generally be composed of several layers. The conventional procedure involves sewing several layers of fabric made from aromatic polyamide fibers together. This package, composed of a plurality of these fabrics, is incorporated into a covering made of coated fabric, for example cotton fabric. An outer layer and backing made of dyed or printed cotton is placed over the covered package thus formed and the vest is finished in such a way that the package can be removed to clean the outer covering.

In vests for protection against bullets and fragments, the textile structure according to the invention may be used for the covering placed around the fabric made of aromatic polyamide fibers. In contrast to the coated fabrics used thus far, this has the important advantage that the loss of anti-ballistic effect that results from coating does not take place. In addition the textile structure according to the invention can also be used for the outer material and backing. In addition to simplifying ordering of stock materials, a higher ballistic protective effect and improved strength of the vest are achieved with the textile structure according to the invention, in comparison to the cotton fabric previously used for this purpose.

Protective clothing which protects against cuts is made using similar procedures. In addition to the fabric layers made of aromatic polyamide fibers, there are generally layers of metal fabric in the clothing which provide protection from cuts. This also applies to the covering, outer layer and backing of protective clothing used to protect against bullets and fragments. Again, the actual layers that protect against cutting may consist of the textile structures according to the invention.

Therefore, the use of the textile structures according to the invention for clothing to protect against stabbing, cutting, bullets, and fragments offers considerable advantages to achieve improved characteristics of protective clothing, including: 1) simpler stocking process for the materials to be used because the required inventory can be reduced considerably; and 2) much reduced strength loss when making the textile structures by replacing cotton fabric, having lower strength, with the textile structures according to the invention. In addition, wearing comfort is considerably improved by comparison with the protective clothing used formerly.

EXAMPLE 1

This example describes the use of a textile structure according to the invention in fencing vests.

A filament yarn made of aromatic polyamide fibers with a titer of 840 dtex is wrapped on a DREF 3 spinning machine with a double sheath. The inner sheath is formed by a polyester fiber with an optical brightener included. The polyester fiber has a titer of 1.7 dtex and a fiber length of 32 mm. The polyester fiber is used in the form of a sliver and is fed into the spinning machinery in accordance with the description for FIG. 1.

The outer sheath is formed of cotton. The cotton is bleached beforehand in loose stock with sodium chlorite and optically brightened. In addition, the cotton processed in the loose stock is also given a finish in order to facilitate the formation of a sliver and processing on the DREF 3 spinning machine. The textile auxiliary products used for this treatment are known in the textile industry.

Wrapping produces a yarn consisting of 40% aromatic polyamide fiber, 30% polyester fiber, and 30% cotton.

The yarn thus obtained is processed in a twill ⅓ weave to form a fabric. The thread count in the warp is 13/cm and in the weft 12/cm. This fabric structure produces a weight per unit area of 510 g/m$^2$.

An average value of 840N is obtained when testing penetrating force.

EXAMPLE 2

Example 1 is repeated using a viscose staple fiber, instead of cotton, having a titer of 1.7 dtex and a fiber length of 40 mm to form the outer sheath. The viscose staple fiber is an ultra-white type, so that the bleaching and optical brightening described in Example 1 in the loose stock are not required.

The fabric is manufactured in the same way as in Example 1. An average value of 830N is obtained in testing penetrating force.

EXAMPLE 3

Examples 3*a* and 3*b* show the influence of the fabric density produced by the thread counts in the warp and weft as well as the related weight per unit area on the penetrating force of the fabrics for fencing vests.

EXAMPLE 3*a*

A fabric is prepared from the yarn described in Example 1 in a plain weave with a thread count of 8/cm in the warp and 7/cm in the weft. The fabric weighs 320 g/m$^2$. The average value of the penetrating force is 710N EXAMPLE 3*b*

A fabric is manufactured from the yarn described in Example 1 using cross-twill ⅔ weave, with a thread count of 9/cm in the warp and weft. The fabric weighs 380 g/m$^2$. The average value of the penetrating force is 690N.

EXAMPLE 4

This example describes the use of textile structures according to the invention in vests which protect against fragments.

A filament yarn made of aromatic polyamide fibers with a titer of 840 dtex is wrapped with a double sheath on a DREF 3 spinning machine. The inner sheath is formed by a polyester fiber. The fiber has a titer of 1.7 dtex and a length of 32 mm. The polyester fiber is used in the form of a sliver and is fed to the spinning machine as described in FIG. 1.

The outer sheath is formed of cotton. The cotton is also used in the form of a sliver. It is supplied as represented in FIG. 1 to the DREF 3 spinning machine.

Wrapping produces a yarn consisting of 40% aromatic polyamide fiber, 30% polyester fiber, and 30% cotton.

The yarn thus obtained is processed in a plain weave to produce a fabric. The thread count is 7/cm in the warp and weft. The fabric is manufactured on a rapier loom.

The resulting fabric is dyed dark green. Vat dyes are used for the cotton outer sheath and disperse dye-stuffs are used for the polyester inner sheath. Dyeing at 135° C. using the disperse dyestuffs also dyes the core made of aromatic polyamide, the color depth of the aromatic polyamide being much lighter than that of the polyester inner sheath.

The fabrics thus produced are further processed to produce a vest to protect against fragments, this fabric being used for the outer layers and lining of the vest, instead of conventional cotton fabrics. A vest is produced that consists of 14 layers of conventional aramid fabric having a weight of 190 g/m$^2$. An additional outer layer and inner layer are formed by the fabric manufactured according to the invention, weighing 283 g/m$^2$.

This vest is subjected to fragmentation testing under the conditions of STANAG 2920. For the testing, 1.1 g fragments are used. A V50 value of 476 m/s is achieved when the dry package is tested. At the speed given, this value means there is a penetration probability of 50%.

When a wet vest is tested, the corresponding value is 456 m/s. In this test, the vest is placed vertically in water for one hour before fragmentation testing after a dripping time of 3 minutes.

The comparison material consists of a vest that is similarly composed of 14 layers of aramid fabric weighing 190 g/m$^2$ each. The outer material and backing in this case consists of a cotton fabric weighing 272 g/m$^2$. In this vest, the V50 value is 455 m/s when tested in the dry state and 428 m/s when tested in the wet state.

These figures indicate a significant increase in antiballistic effectiveness when using a fabric manufactured according to the invention.

EXAMPLE 5

The fabric from Example 4 is used to manufacture a bulletproof vest. For this purpose, 20 layers of aramid fabric weighing 280 g/m$^2$ are used. Each two additional layers are composed of the fabric produced according to the invention both on the outside and the inside. These layers serve as a covering for holding the so-called ballistic package and as an outer material and backing. Therefore, this vest has a total of 24 layers. From outside to inside, the vest is composed of the following layers: two layers of the fabric according to the invention, 20 layers of aramid fabric, and two layers of the fabric according to the invention.

The shooting test for the vest manufactured experimentally is compared to a vest that consists of 24 layers of aramid fabric weighing 280 g/m$^2$ as well as, over the outside and on the inside of the ballistic package, one layer each of a coated polyester fabric and as the outer layer and backing, a cotton fabric. Therefore, the comparative vest has a total of 28 layers. From outside to inside, the vest consists of the following layers: outer material made of cotton fabric, coated polyester fabric, 24 layers of aramid fabric, coated polyester fabric, and lining made of cotton fabric.

The shooting test is performed according to the NIJ standard. In both cases, none of the test projectiles passed through the protective vest.

This comparison shows that using the fabric according to the invention permits lighter vests having an equivalent antiballistic effect.

What is claimed is:

1. Clothing to be worn, protective against penetration by stabbing, fragments or bullets, said clothing comprising a plurality of textile structure layers, at least an outermost layer and an innermost layer of said plurality of textile structure layers comprising a fabric which comprises wrapped yarns, said yarns having a yarn titer ranging from about 600 to about 4,000 dtex and comprising a core comprised of penetration resistant filament yarn selected from the group consisting of aromatic polyamide fibers, high-strength polyolefin fibers and mixtures thereof, and a wrapped outer sheath comprising at least one layer comprising readily color-modifiable fibers selected from the group consisting of cotton, wool, viscose staple fibers, polyamide staple fibers, polyester staple fibers polyacrylonitrile staple fibers and mixtures thereof.

2. The clothing according to claim 1, wherein the filament yarn is antiballistic.

3. The clothing according to claim 1, wherein the clothing protects against stabbing.

4. The clothing according to claim 1, wherein the clothing protects against cuts.

5. The clothing according to claim 1, wherein the clothing protects against fragments.

6. The clothing according to claim 1, wherein the clothing is bulletproof.

7. Clothing according to claim 1, wherein the filament yarn is aromatic polyamide fibers.

8. Clothing according to claim 1, wherein the filament yarn is high-strength polyolefin fibers.

9. Clothing according to claim 1, wherein the filament yarn is polyethylene fibers.

10. Clothing according to claim 1, wherein the polyethylene fibers are made by the "gel" spinning process.

11. Clothing according to claim 1, wherein the filament yarn is a mixture of polyethylene fibers and aromatic polyamide fibers and the polyethylene fibers are made by the "gel" spinning process.

12. Clothing according to claim 1, wherein the sheath of the wrapped yarn has one layer.

13. Clothing according to claim 1, wherein the sheath of the wrapped yarn has two layers.

14. Clothing according to claim 13, wherein the two layers are made of different fibers.

15. Clothing according to claim 13, wherein the two layers are made of the same fibers.

16. Clothing according to claim 1, wherein the readily color-modifiable fibers can be easily dyed, printed or optically brightened.

17. Clothing according to claim 1, wherein the core of the wrapped yarn is made of aromatic polyamide filament yarns, an inner layer of the sheath is made of a polyester staple fiber and an outer layer of the sheath is made of at least one of a cotton and viscose staple fiber.

18. The clothing according to claim 1, wherein said core excludes staple fibers.

19. The clothing according to claim 1, wherein a ratio of said filament yarn to said readily color-modifiable fibers is sufficiently high to resist penetration by stabbing, fragments or bullets.

20. The clothing according to claim 1, wherein said filament yarn comprises about 40% by weight of said yarns.

21. Clothing according to claim 1, in the form of a bulletproof vest.

22. Clothing according to claim 1, in the form of a fragment proof vest.

23. The clothing according to claim 1, wherein said titer ranges from 600 to 3,000 dtex.

24. Clothing to be worn, protective against penetration by stabbing, fragments or bullets, said clothing comprising a plurality of textile structure layers, at least an outermost layer and an innermost layer of said plurality of textile structure layers comprising a woven fabric, said fabric comprising warp and weft wrapped yarns, said wrapped yarns comprising a core comprised of penetration resistant filament yarn selected from the group consisting of aromatic polyamide fibers, high-strength polyolefin fibers and mixtures thereof, and an outer sheath comprising at least one layer made of readily color-modifiable fibers selected from the group consisting of cotton, wool, viscose staple fibers, polyamide staple fibers, polyester staple fibers polyacrylonitrile staple fibers and mixtures thereof, wherein said textile structure layers comprising a woven fabric provide said clothing with protection against penetration by stabbing, fragments or bullets.

25. The clothing according to claim 24, wherein said yarns have a titer ranging from 600 to 3,000 dtex.

26. Clothing according to claim 24, wherein said textile structure provides said clothing with protection against penetration by stabbing.

27. Clothing according to claim 24, wherein said textile structure provides said clothing with protection against penetration by fragments.

28. Clothing according to claim 24, wherein said textile structure provides said clothing with protection against penetration by bullets.

29. A fencing vest comprising at least one fabric layer, said fabric layer comprising wrapped yarns having a yarn titer ranging from about 600 dtex to 4,000 dtex, said wrapped yarns consisting essentially of a core of penetration resistant filament yarn selected from the group consisting of aromatic polyamide fibers, high-strength polyolefin fibers and mixtures thereof, and an outer sheath comprising at least one layer of readily color-modifiable fibers selected from the group consisting of cotton, wool, viscose staple fibers, polyamide staple fibers, polyester staple fibers, polyacrylonitrile staple fibers and mixtures thereof.

30. The fencing vest of claim 29, wherein said fencing vest has a penetration resistance of at least 800N.

* * * * *

UNITED STATES PATENT AND TRADEMARK OFFICE

CERTIFICATE OF CORRECTION

PATENT NO. : 5,514,457

DATED : May 7, 1996

INVENTOR(S) : Achim G. FELS, Georg K. BRUSTMANN and Dieter H. P. SCHUSTER

It is certified that error appears in the above-identified patent and that said Letters Patent is hereby corrected as shown below:

Claim 1, line 14, (col. 10, line 54), change "fibers polyacryloni-" to -- fibers, polyacryloni- --.

Claim 24, line 13, (col. 12, line 11), change "fibers polyacryloni-" to -- fibers, polyacryloni- --.

Signed and Sealed this

Thirteenth Day of August, 1996

Bruce Lehman

*Attest:*

BRUCE LEHMAN

*Attesting Officer*

*Commissioner of Patents and Trademarks*